US010775121B2

(12) United States Patent
Bender

(10) Patent No.: US 10,775,121 B2
(45) Date of Patent: Sep. 15, 2020

(54) FIREARM MECHANISM

(71) Applicant: In Ovation LLC, Vadnais Heights, MN (US)

(72) Inventor: Terrence Dwight Bender, Minneapolis, MN (US)

(73) Assignee: In Ovation LLC, Vadnais Heights, MN (US)

( * ) Notice: Subject to any disclaimer, the term of this patent is extended or adjusted under 35 U.S.C. 154(b) by 0 days.

(21) Appl. No.: 16/021,011

(22) Filed: Jun. 27, 2018

(65) Prior Publication Data

US 2019/0017765 A1 Jan. 17, 2019

Related U.S. Application Data

(60) Provisional application No. 62/526,355, filed on Jun. 29, 2017, provisional application No. 62/620,459, filed on Jan. 22, 2018.

(51) Int. Cl.

| | |
|---|---|
| ***F41A 19/04*** | (2006.01) |
| ***F41A 19/44*** | (2006.01) |
| ***F41A 19/12*** | (2006.01) |
| ***F41A 3/84*** | (2006.01) |
| *F41A 5/28* | (2006.01) |
| *F41A 19/46* | (2006.01) |
| *F41A 19/16* | (2006.01) |

(52) U.S. Cl.

CPC ..... *F41A 19/04* (2013.01); *F41A 3/84* (2013.01); *F41A 19/12* (2013.01); *F41A 19/44* (2013.01); *F41A 5/28* (2013.01); *F41A 19/16* (2013.01); *F41A 19/46* (2013.01)

(58) Field of Classification Search

CPC ..... F41A 3/78–84; F41A 17/58; F41A 17/66; F41A 17/68; F41A 17/76; F41A 19/04; F41A 19/12; F41A 19/44

USPC ..... 89/129.01–131, 149, 150, 198

See application file for complete search history.

(56) References Cited

U.S. PATENT DOCUMENTS

| | | | | |
|---|---|---|---|---|
| 813,802 A | | 2/1906 | Johnson | |
| 2,779,249 A | * | 1/1957 | Saetter-Lassen | F41A 3/84 89/198 |
| 3,776,095 A | * | 12/1973 | Atchisson | F41A 11/02 89/128 |
| 4,057,003 A | * | 11/1977 | Atchisson | F41A 3/26 89/138 |
| 4,461,203 A | | 7/1984 | Jawdat | |
| 4,930,399 A | * | 6/1990 | Trevor, Jr. | F41A 3/46 89/185 |
| 5,770,814 A | * | 6/1998 | Ealovega | F41A 19/04 89/131 |

(Continued)

*Primary Examiner* — Stephen Johnson
*Assistant Examiner* — Benjamin S Gomberg
(74) *Attorney, Agent, or Firm* — Vidas, Arrett & Steinkraus

(57) ABSTRACT

In some embodiments, a firearm comprises a lower receiver, a bolt carrier, a buffer sleeve and a buffer. The lower receiver is arranged to support a hammer and an auto-sear. The bolt carrier comprises a body and a striker moveable with respect to the body between a first position and a second position. The buffer sleeve is arranged to contact the bolt carrier and to contact a buffer spring. The buffer sleeve defines an internal cavity and comprises open ends. The buffer is oriented in the internal cavity and extends through the buffer sleeve. The buffer is arranged to contact the striker and move the striker to the second position.

14 Claims, 8 Drawing Sheets

(56) References Cited

U.S. PATENT DOCUMENTS

| | | | | |
|---|---|---|---|---|
| 5,909,002 | A * | 6/1999 | Atchisson | F41A 3/70 42/1.06 |
| 8,677,664 | B2 * | 3/2014 | Caravaggi | F41C 23/06 42/1.06 |
| 8,800,424 | B2 * | 8/2014 | Gangl | F41A 3/84 89/198 |
| 8,899,141 | B2 * | 12/2014 | Reynolds | F41A 5/12 89/129.01 |
| 9,103,611 | B2 * | 8/2015 | Neitzling | F41A 5/20 |
| 9,228,786 | B2 * | 1/2016 | Sullivan | F41A 3/26 |
| 9,297,609 | B2 * | 3/2016 | Burt | F41C 23/16 |
| 9,459,060 | B2 * | 10/2016 | Langevin | F41A 3/66 |
| 10,001,336 | B2 * | 6/2018 | Brown | F41A 19/45 |
| 10,088,268 | B2 * | 10/2018 | Hewes | F41C 23/14 |
| 10,113,829 | B2 * | 10/2018 | Nachefski | F41A 17/56 |
| 10,488,136 | B2 * | 11/2019 | Sullivan | F41A 17/02 |
| 10,545,005 | B2 * | 1/2020 | Bender | F41A 3/56 |
| 2008/0000128 | A1 * | 1/2008 | Newman | F41A 3/82 42/16 |
| 2012/0180354 | A1 | 7/2012 | Sullivan | |
| 2013/0118343 | A1 * | 5/2013 | Hirt | F41A 19/06 89/149 |
| 2014/0102287 | A1 | 4/2014 | Jebsen | |
| 2015/0338178 | A1 | 11/2015 | Neitzling | |
| 2016/0370135 | A1 | 12/2016 | Plumb | |
| 2017/0115078 | A1 | 4/2017 | Plumb | |
| 2017/0299323 | A1 | 10/2017 | Nachefski | |
| 2018/0080732 | A1 | 3/2018 | Brown | |

* cited by examiner

FIREARM MECHANISM

CROSS-REFERENCE TO RELATED APPLICATIONS

This application claims the benefit of U.S. Patent Application No. 62/526,355, filed Jun. 29, 2017, and the benefit of U.S. Patent Application No. 62/620,459, filed Jan. 22, 2018, the entire content of which are hereby incorporated herein by reference.

BACKGROUND OF THE INVENTION

This invention relates to automatic machine guns and fire control mechanisms.

Automatic firearms generally have high firing rates. For example, M4 and M16 machine guns can fire 700-900 or more rounds per minute. While a high firing rate has certain benefits, there can be drawbacks such as decreased accuracy and increased ammunition consumption.

There remains a need for firearm mechanisms having variable rates of fire.

There remains a need for novel firearm mechanisms, as well as firearm mechanisms that can be retrofit into existing machine guns to reduce the cycle rate.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

BRIEF SUMMARY OF THE INVENTION

In some embodiments, a firearm mechanism comprises a bolt carrier comprising a rear cavity, a buffer sleeve and a buffer. The buffer sleeve defines an internal cavity. The buffer sleeve is arranged to contact the bolt carrier and is arranged to contact a buffer spring. The buffer is arranged to move with respect to the bolt carrier and the buffer sleeve. The buffer is at least partially oriented in the buffer sleeve. A length of the buffer is greater than a length of the internal cavity.

In some embodiments, a firearm mechanism comprises a hammer, an auto-sear, a bolt carrier, a buffer and a buffer sleeve. The bolt carrier comprises a body and a striker moveable with respect to the body between a first position and a second position. The striker is biased to the first position by a biasing mechanism. The striker does not contact the auto-sear in the first position. The striker contacts the auto-sear in the second position and is arranged to operate the auto-sear in the second position. The buffer sleeve is arranged to contact the bolt carrier. The buffer sleeve surrounds the buffer. The buffer is arranged to contact the striker. A length of the buffer is greater than a length of the buffer sleeve.

In some embodiments, a firearm comprises a lower receiver, a bolt carrier, a buffer sleeve and a buffer. The lower receiver is arranged to support a hammer and an auto-sear. The bolt carrier comprises a body and a striker moveable with respect to the body between a first position and a second position. The buffer sleeve is arranged to contact the bolt carrier and to contact a buffer spring. The buffer sleeve defines an internal cavity and comprises open ends. The buffer is oriented in the internal cavity and extends through the buffer sleeve. The buffer is arranged to contact the striker and move the striker to the second position.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
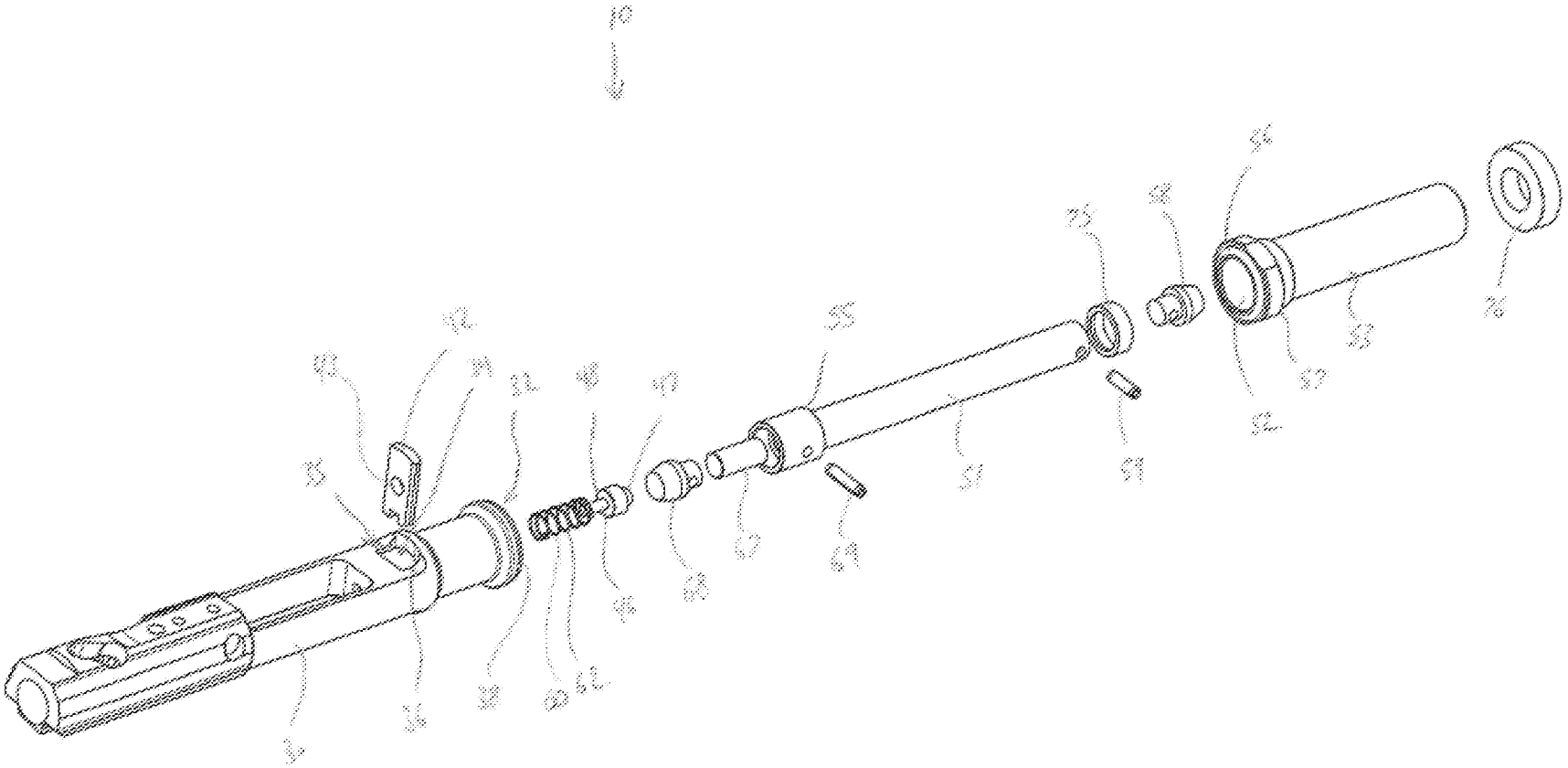
FIG. 1 shows an exploded view of an embodiment of a firearm mechanism.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
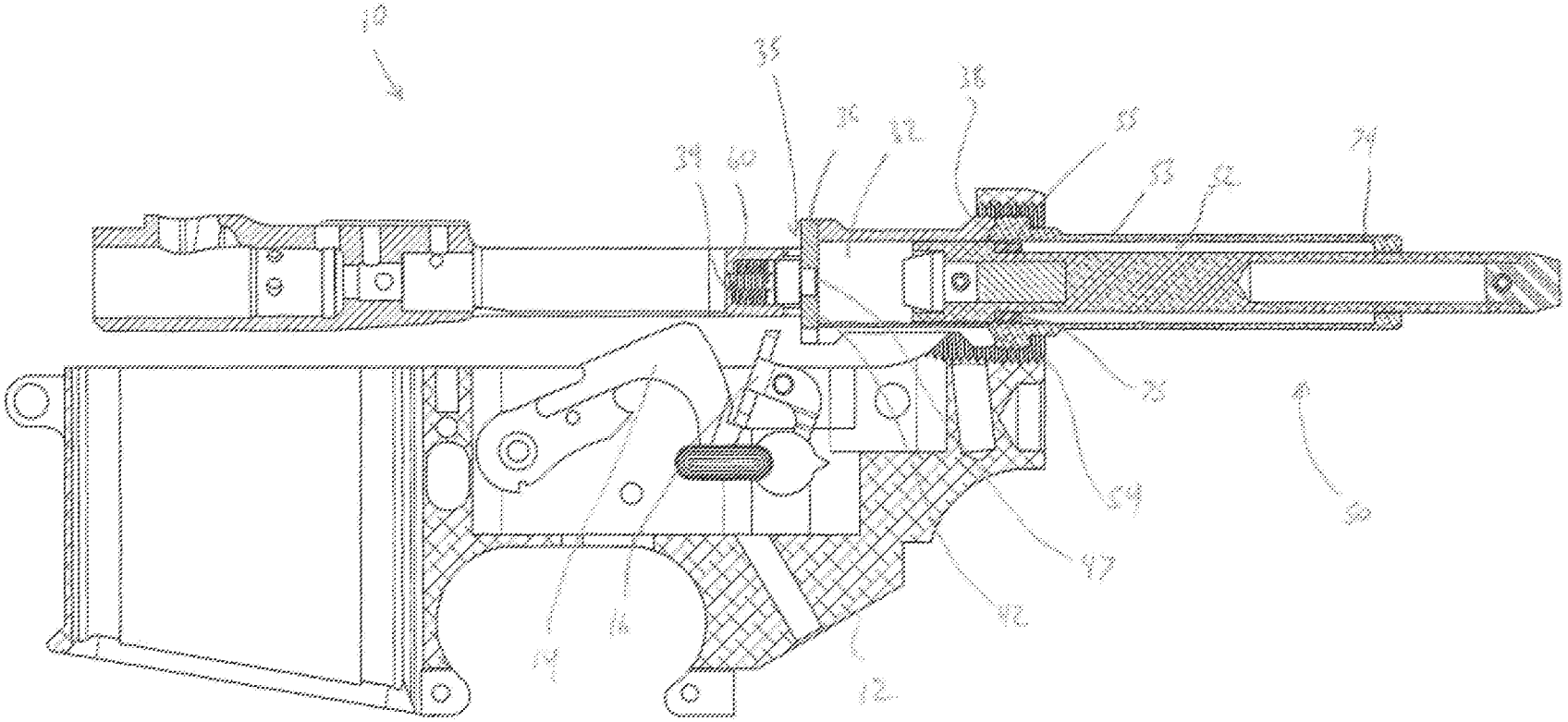
FIG. 2 shows a cross-sectional view of a portion of a firearm comprising an embodiment of a firearm mechanism.

FIGS. 1 and 2 show an embodiment of a firearm mechanism 10.

In some embodiments, the parts of the firearm mechanism 10 are suitable for use in standard M4 and M16 firearms as drop-in replacement parts, without requiring any change to other parts of the firearm. Reference to an M4 and/or M16 herein is intended to include various M16 rifle models and M4 rifle models and analogues thereof.

In some embodiments, when the firearm mechanism 10 is used in an M4, the resulting modified firearm will have a slower firing rate than the standard military specification M4.

In some embodiments, a firearm mechanism 10 comprises a bolt carrier 30, a striker 42 and a buffer mechanism 50. In some embodiments, the striker 42 is carried by the bolt carrier 30. In some embodiments, the striker 42 is moveable with respect to the bolt carrier 30. In some embodiments, the buffer mechanism 50 is arranged to contact and move the striker 42, and the striker 42 is arranged to cause a firearm to fire. In some embodiments, the striker 42 is arranged to operate an auto-sear of a firearm.

In some embodiments, the bolt carrier 30 and buffer mechanism 50 are suitable for use as a replacement for a mil-spec M4 bolt carrier and buffer. In some embodiments, the bolt carrier 30 is constructed and arranged to be used with a mil-spec M4 bolt. In some embodiments, the buffer mechanism 50 is constructed and arranged to be used with a mil-spec buffer spring.

In some embodiments, the buffer mechanism 50 comprises a buffer 51 and a buffer sleeve 53. Desirably, the buffer 51 is moveable with respect to the buffer sleeve 53. In some embodiments, the buffer sleeve 53 defines a cavity 52 and the buffer 51 is oriented in the cavity 52. In some embodiments, the buffer sleeve 53 comprises a tubular shape having open front and rear ends. In some embodiments, the buffer sleeve 53 comprises a flange 57 arranged to contact a buffer spring (not illustrated), and the buffer sleeve 53 can be biased by the buffer spring in a manner similar to the way the buffer spring would bias a mil-spec buffer.

In some embodiments, the buffer 51 comprises a reciprocating member that is arranged to cause firing of a firearm. In some embodiments, the buffer 51 is constructed and arranged to impact other portions of a firearm. In some embodiments, a first end of the buffer 51 comprises a bumper 68. In some embodiments, a second end of the buffer 51 comprises a bumper 58. The bumpers 58, 68 can be made from any suitable materials and are desirably elastically deformable under the loading experienced during a firing cycle. In some embodiments, the bumpers 58, 68 comprise rubber or urethane. In some embodiments, the bumpers 58, 68 are attached to the buffer 51 with respective pins 59, 69.

In some embodiments, the buffer 51 is generally free to move with respect to the bolt carrier 30 and with respect to the buffer sleeve 53.

In some embodiments, a magnet 76 is provided. Magnetic forces provided by the magnet 76 can be used to bias the buffer 51 and change travel characteristics of the buffer 51 during shooting.

FIG. 2 shows an embodiment of a firearm mechanism 10 positioned with respect to an embodiment of a lower receiver 12. In some embodiments, the lower receiver 12 comprises a standard military specification M4 or M16 lower receiver. In some embodiments, a lower receiver 12 comprises a hammer 14 and an auto-sear 16. In some embodiments, the hammer 14 comprises a sear 18 arranged to contact the sear of a finger trigger (not illustrated). In some embodiments, the hammer 14 and auto-sear 16 comprise standard military specification parts.

In some embodiments, the striker 42 is moveable with respect to the bolt carrier 30 between first and second positions. In some embodiments, the striker 42 is biased to the first position by a biasing mechanism 60. In some embodiments, when the striker 42 is in its second position and the bolt carrier 30 is properly oriented with respect to the lower receiver 12, the striker 42 will operate the auto-sear 16 and fire a round.

In some embodiments, the bolt carrier 30 comprises a cavity 32. In some embodiments, the cavity 32 is open to the rear end 38 of the bolt carrier 30. In some embodiments, the cavity 32 of the bolt carrier 30 is aligned with the cavity 52 of the buffer sleeve 53. In some embodiments, a portion of the buffer 51 is oriented in the cavity 32 of the bolt carrier 30 during a portion of a firing cycle. In some embodiments, the buffer 51 is arranged to travel along the length of the cavity 32 of the bolt carrier 30 and along the length of the cavity 52 of the buffer sleeve 53.

In some embodiments, the rear end 38 of the bolt carrier 30 and the front end 54 of the buffer sleeve 53 are arranged to engage one another and self-align. In some embodiments, the front end 54 of the buffer sleeve 53 comprises an inclined surface, peak or frustoconical surface 56 arranged to engage a complimentary shaped declined surface, valley or inverse frustoconical surface of the rear end 38 of the bolt carrier 30. The complimentary shaped ends 38, 54 desirably encourage the bolt carrier 30 and buffer sleeve 53 to align such that a central axis of the cavity 32 of the bolt carrier 30 is coaxial with a central axis of the cavity 52 of the buffer sleeve 53.

In some embodiments, the rear end 38 of the bolt carrier 30 is chamfered. In some embodiments, the front end 52 of the buffer 50 is chamfered. Chamfers can help the buffer 51 to pass smoothly across the transition between the bolt carrier cavity 32 and the buffer cavity 52.

In some embodiments, the striker 42 is positioned at an end of the bolt carrier cavity 32, and the buffer 51 is arranged to contact the striker 42. Desirably, the buffer 51 can impact the striker 42 and move the striker 42 to its second position with respect to the bolt carrier 30.

In some embodiments, the bolt carrier 30 comprises a cavity 34 and a slot 35 arranged to support the striker 42. In some embodiments, the striker 42 is positioned in the slot 35. In some embodiments, a striker pin 46 is received in the cavity 34 and arranged to engage the striker 42. In some embodiments, an engaging portion 47 of the striker pin 46 is received in an aperture 43 in the striker 42.

In some embodiments, the biasing mechanism 60 comprises a coil spring 62 extending around the striker pin 46. In some embodiments, the striker pin 46 comprises a flange 48 arranged to engage the biasing mechanism 60. In some embodiments, the biasing mechanism 60 and striker pin 46 can be installed in the cavity 34, the biasing mechanism 60 can be compressed, and the striker 42 installed in the slot 35, wherein the engaging portion 47 of the striker pin 46 can engage the striker 42. The biasing mechanism 60 and striker pin 46 can bias the striker 42 against a flange 36 of the bolt carrier 30. In some embodiments, the striker 42 abuts the flange 36 when the striker 42 is in the first position with respect to the bolt carrier 30.

In some embodiments, the buffer 51 comprises a flange 55 constructed and arranged to receive force applied by the buffer sleeve 53. In some embodiments, the buffer sleeve 53 comprises a flange 74 constructed and arranged to apply force to the buffer 51. In some embodiments, the flange 74 extends into the cavity 52 of the buffer sleeve 53. In some embodiments, a bumper 75 is positioned between the impacting portions of the buffer 51 and the buffer sleeve 53, for example being positioned between the flanges 55, 74.

Figure 3:
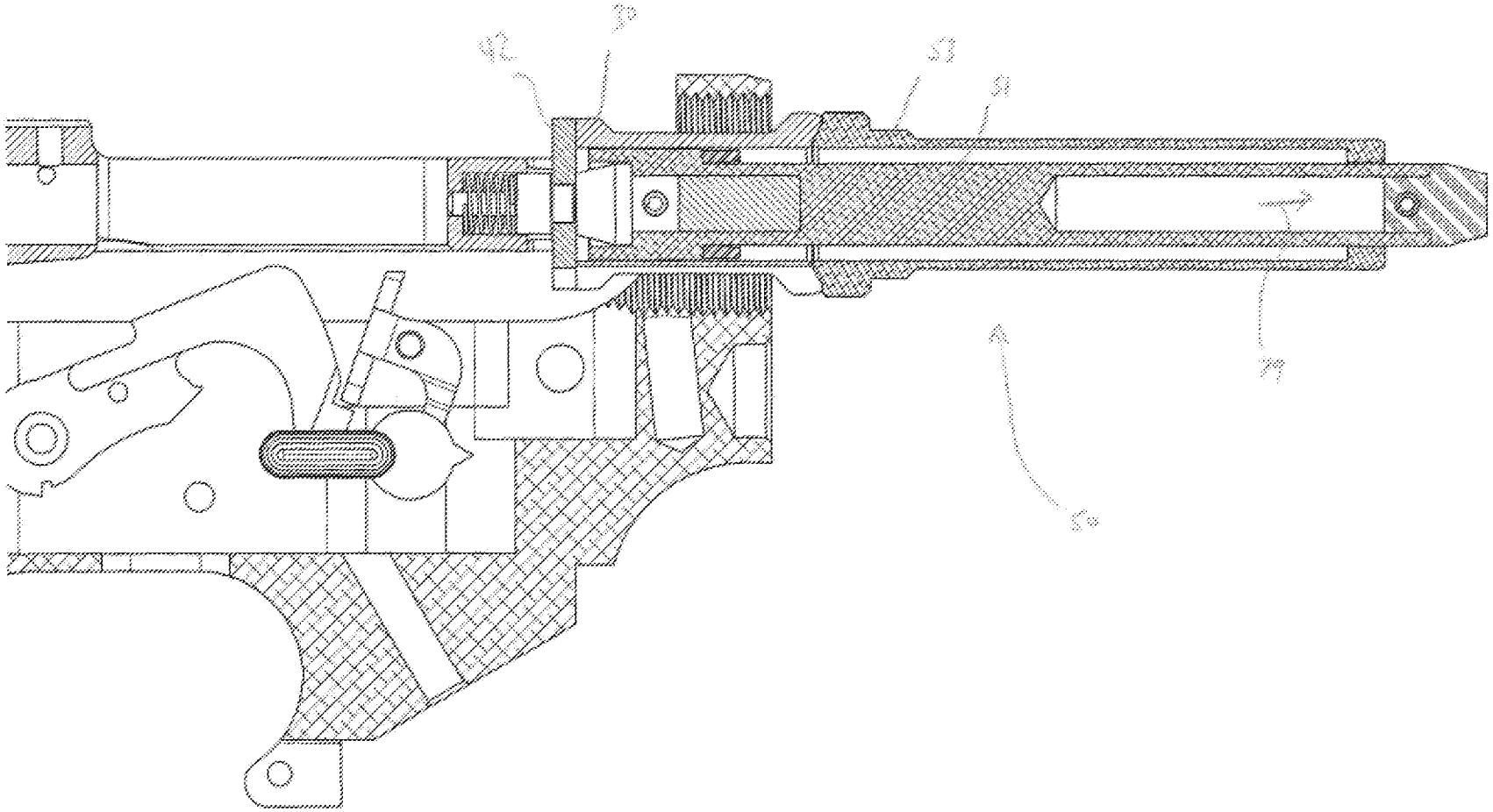
FIGS. 3-8 show the operation of an embodiment of a firearm mechanism during a firing sequence.

FIG. 3 illustrates an embodiment of a firearm mechanism 10 at a point in time after a first round has been fired. The bolt carrier 30 and buffer mechanism 50 are traveling in the rearward direction 79, for example under the force of expanding gasses from the first round being applied to the bolt carrier 30. In some embodiments, the bolt carrier 30 contacts and biases the buffer sleeve 53 in the rearward direction 79. In some embodiments, the buffer 51 bottoms out against the striker 42 and moves in the rearward direction 79 along with the bolt carrier 30.

In some embodiments, the buffer 51 is longer than the combined lengths of the bolt carrier cavity 32 and the buffer sleeve cavity 52. In some embodiments, the buffer 51 extends from the striker plate 42 of the buffer 30, through the bolt carrier cavity 32 and the buffer sleeve cavity 52, and extends out of the rear end of the buffer sleeve 53.

Figure 4:
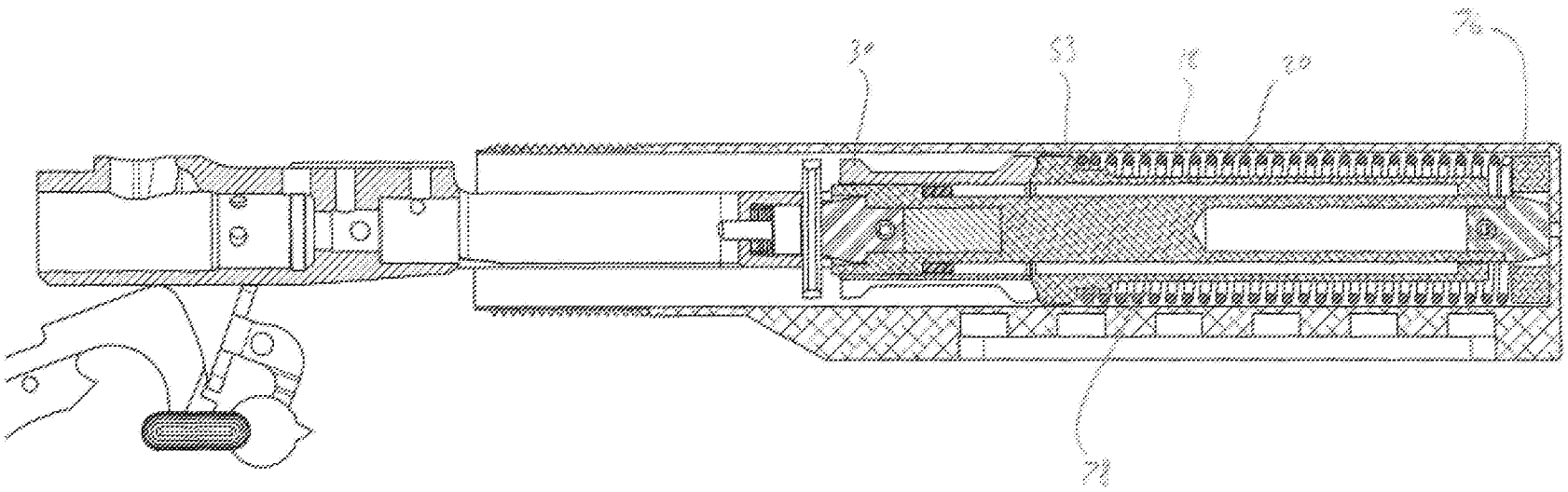

Referring to FIG. 4, the bolt carrier 30 and buffer mechanism 50 move rearward and in some embodiments, move into a receiver extension tube 18. FIG. 4 shows the buffer 51 in its rearmost position. In some embodiments, the rear bumper 58 contacts the back wall of the receiver extension tube 18, stopping travel of the buffer 51 and in some embodiments, stopping travel of the bolt carrier 30.

In some embodiments, a magnet 76 is provided to apply magnetic forces to various components of the firearm mechanism 10. In some embodiments, a magnet 76 is provided at the rear of the receiver extension tube 18. In some embodiments, a magnet 76 comprises a ring defining a central aperture, and a portion of the buffer 51 can be oriented in the central aperture during certain times of a firing operation. In some embodiments, the buffer spring 20 contacts the magnet 76.

In some embodiments, the buffer spring 20 has become compressed and biases the buffer sleeve 53 in a forward direction 78. In some embodiments, the buffer sleeve 53 contacts the bolt carrier 30, and the buffer sleeve 53 and the bolt carrier 30 move in the forward direction.

In some embodiments, the buffer 51 will remain in its rearward position, for example under the force of inertia and/or under force provided by a magnet 76, as the buffer sleeve 53 and bolt carrier 30 move with respect to the buffer 51.

Figure 5:
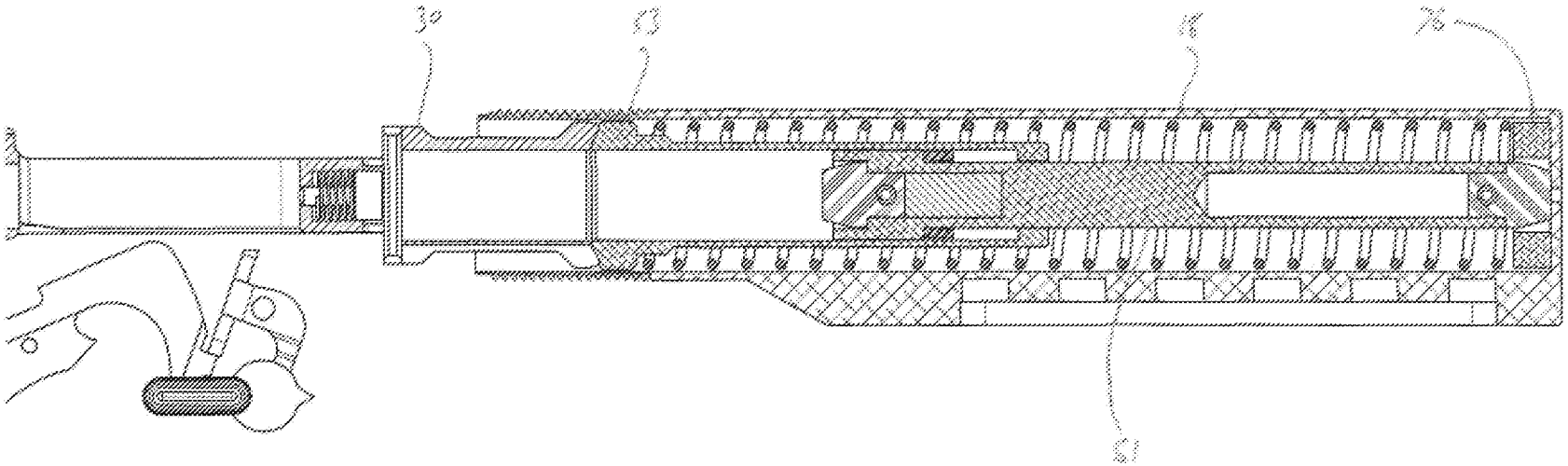

FIG. 5 shows the buffer sleeve 53 and bolt carrier 30 displaced from their respective positions in FIG. 4. In some embodiments, the buffer 51 remains positioned near the rear of the receiver extension tube 18. In some embodiments, the magnet 76 helps to retain the buffer 51 in a temporary position near the rear of the receiver extension tube 18.

Figure 6:
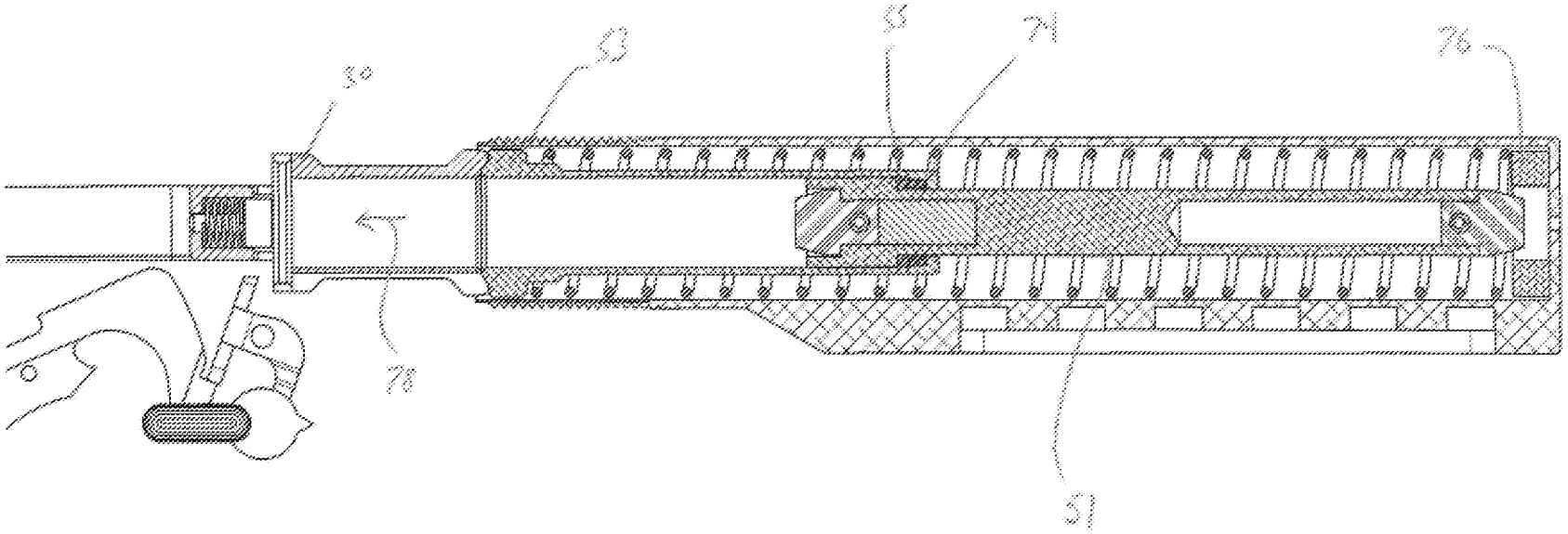

In FIG. 6, the buffer sleeve 53 and bolt carrier 30 have moved farther in the forward direction 78, and the buffer sleeve 53 is positioned to apply force to the buffer 51. For example, the flange 74 of the buffer sleeve 53 can transfer force to the flange 55 of the buffer 51, and forward momentum can transfer from the buffer sleeve 53 to the buffer 51. The buffer 51 begins to travel in the forward direction 78.

Figure 7:
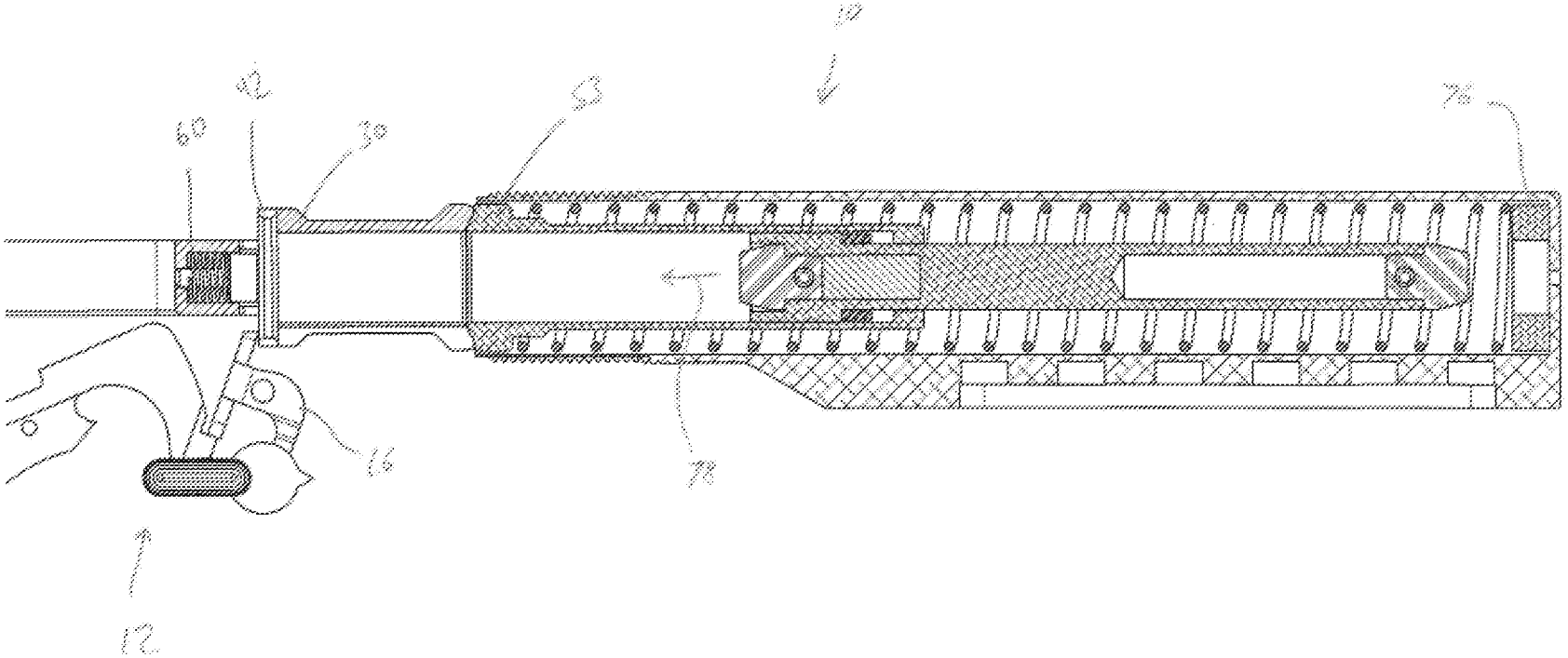

FIG. 7 shows the bolt carrier 30 and buffer sleeve 53 reaching their forward positions with respect to the lower receiver 12 and stop traveling. FIG. 7 represents a time when a mil-spec M16 generally fires a second round; however, the firearm mechanism 10 does not yet fire. Due to positioning of the bolt carrier 30, the striker 42 is positioned near the auto-sear 16. The striker 42 remains biased to its first position with respect to the bolt carrier 30 by the biasing mechanism 60. The buffer 51 continues to travel in the forward direction 78 and will eventually hit the striker 42.

Figure 8:
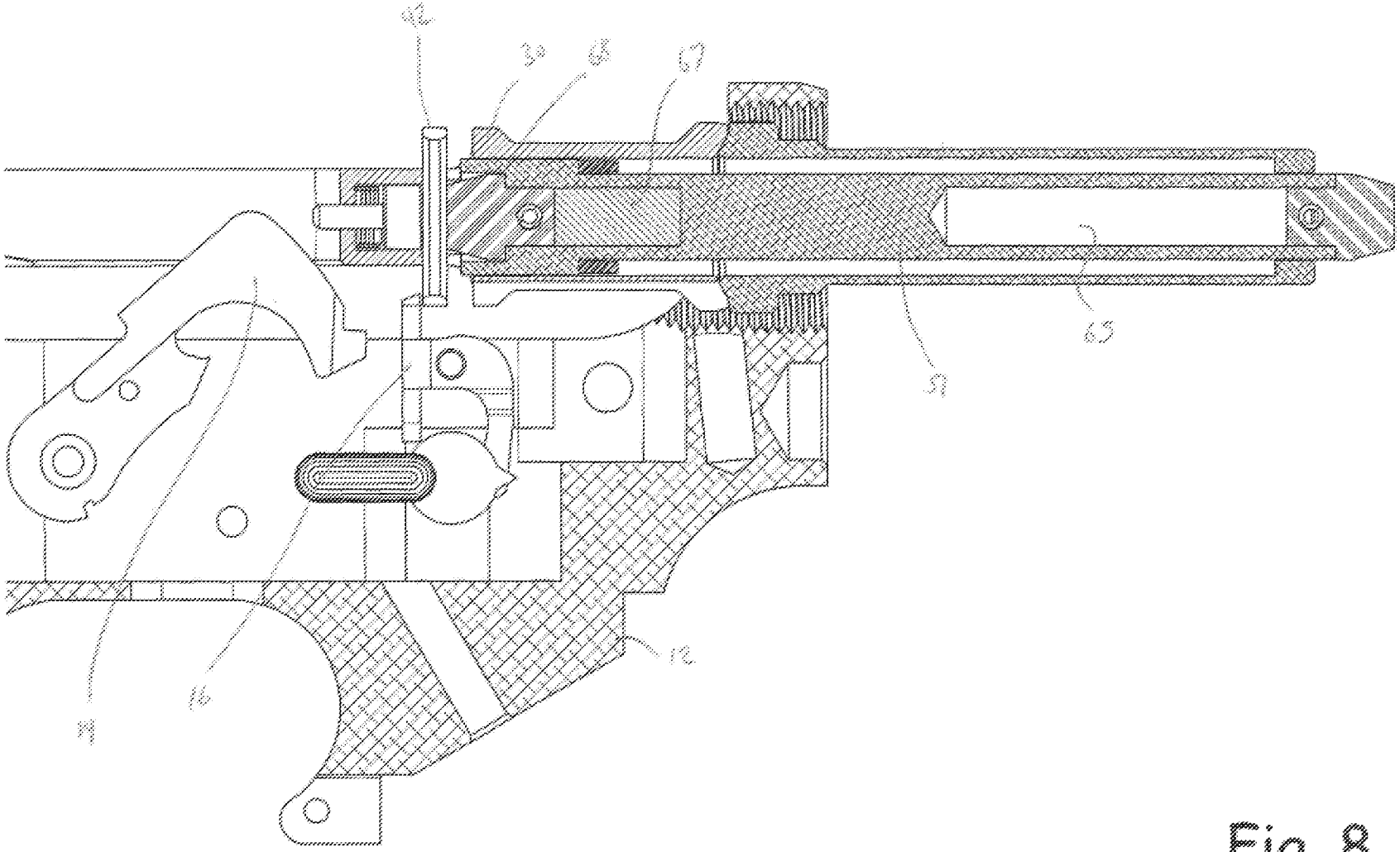

FIG. 8 shows the buffer 51 impacting the striker 42 and moving the striker 42 to its second position with respect to the bolt carrier 30. In the second position, the striker 42 can contact and operate the auto-sear 16, releasing the hammer 14 and firing another round.

A firearm comprising a firearm mechanism 10 as disclosed herein can fire more slowly in a fully automatic firing mode than a traditional version of the firearm. The travel of the buffer 51 provides a time delay in the cycling rate.

Specifics of the components of the firearm mechanism 10 can be adjusted to provide different adjustments in cycle rate.

In some embodiments, the buffer 51 comprises a weight 67. In some embodiments, the weight 67 comprises a material that is denser than the material used for the buffer 51. In some embodiments, the weight 67 is provided in a forward cavity and arranged to contact the front bumper 68. The weight 67 can have any suitable size and shape, and can be made from any suitable material.

In some embodiments, the buffer 51 comprises one or more weight reduction cavities. As shown in FIG. 8, the buffer 51 includes a rear cavity 65 that is largely hollow.

In some embodiments, the weight(s) 67 help deliver energy to the striker 42.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A firearm mechanism comprising:

a hammer;

an auto-sear;

a bolt carrier comprising a body and a striker moveable with respect to the body between a first position and a second position, the striker biased to the first position by a biasing mechanism, the striker not contacting the auto-sear in the first position, the striker contacting the auto-sear in the second position;

a buffer moveable with respect to the bolt carrier, the buffer arranged to contact the striker;

a buffer sleeve arranged to contact the bolt carrier, the buffer sleeve surrounding the buffer, a length of the buffer being greater than a length of the buffer sleeve.

2. The firearm mechanism of claim 1, the buffer protruding from a first end of the buffer sleeve and from a second end of the buffer sleeve.

3. The firearm mechanism of claim 1, the buffer comprising a first bumper at a first end and a second bumper at a second end.

4. The firearm mechanism of claim 3, the first bumper arranged to contact the striker.

5. The firearm mechanism of claim 4, the second bumper arranged to contact a receiver extension tube.

6. The firearm mechanism of claim 1, the buffer sleeve arranged to contact a buffer spring.

7. The firearm mechanism of claim 6, the buffer comprising a flange arranged to receive force applied by the buffer sleeve.

8. The firearm mechanism of claim 6, wherein surfaces of the bolt carrier and buffer sleeve that contact one another comprise complimentary shapes arranged to self-align the bolt carrier and buffer sleeve on a common axis.

9. The firearm mechanism of claim 1, the bolt carrier body defining a cavity adjacent to the striker.

10. The firearm mechanism of claim 9, wherein a portion of the buffer is arranged to occupy the cavity.

11. The firearm mechanism of claim 10, wherein the buffer is arranged to exit the cavity during a firing cycle.

12. The firearm mechanism of claim 9, wherein the length of the buffer is greater than a length of the cavity plus the length of the buffer sleeve.

13. The firearm mechanism of claim 1, comprising a lower receiver arranged to support the hammer and the auto-sear.

14. A firearm mechanism comprising:

a hammer;

an auto-sear;

a bolt carrier comprising a body and a striker moveable with respect to the body between a first position and a second position, the striker biased to the first position by a biasing mechanism, the striker not contacting the auto-sear in the first position, the striker arranged to operate the auto-sear in the second position;

a buffer moveable with respect to the bolt carrier, the buffer arranged to move the striker to the second position; and a buffer sleeve arranged to contact the bolt carrier, the buffer sleeve surrounding the buffer, a length of the buffer being greater than a length of the buffer sleeve.

* * * * *